United States Patent [19]

Wass

[11] Patent Number: 4,959,034

[45] Date of Patent: Sep. 25, 1990

[54] PUNCTURE DISC INFLATION VALVE WITH IMPROVED CUTTING BAYONET

[76] Inventor: Lloyd G. Wass, 1670 Blackhawk Cove, Eagan, Minn. 55122

[21] Appl. No.: 262,273

[22] Filed: Oct. 25, 1988

[51] Int. Cl.[5] ..... B63B 35/58

[52] U.S. Cl. ..... 441/41; 441/93

[58] Field of Search ..... 441/9, 40, 41, 92–97; 222/5; 30/358, 360, 366, 367, 167, 168

[56] References Cited

U.S. PATENT DOCUMENTS

| | | | |
|---|---|---|---|
| 3,014,619 | 12/1961 | Moran | 222/5 |
| 3,815,783 | 6/1974 | Hirata | 441/95 |
| 4,267,944 | 5/1981 | Mackal | 222/5 |

*Primary Examiner*—Joseph F. Peters, Jr.
*Assistant Examiner*—Jesûs D. Sotelo
*Attorney, Agent, or Firm*—Kinney & Lange

[57] ABSTRACT

A raft inflation valve includes a cylinder head which is connected to a pressure vessel and which has an inlet communicating with the pressure vessel, a recess for receiving a puncture disc, and a passage which connects the inlet and the recess and which is covered by the puncture disc. A disc retainer holds the puncture disc in position in the cylinder head covering the passage. The bayonet piston has a cutting edge formed between an abbreviated cutting face and an inverted conical cutting head for cutting and not tearing the puncture disc upon collision. A bias spring applies a bias force to the bayonet piston, and an actuating cable ball prevents movement of the bayonet piston until the cable is pulled. Once the cable has been pulled to remove the ball, the bayonet piston is driven by the bias force toward the disc to clearly cut and puncture the disc and permit flow of gas from the pressure vessel through the inlet passage through the disc to the outlet passage in the outlet of the valve. The geometry of the bayonet piston allows it to be cleanly blown free of the puncture so as to not inhibit the flow of gas.

10 Claims, 5 Drawing Sheets

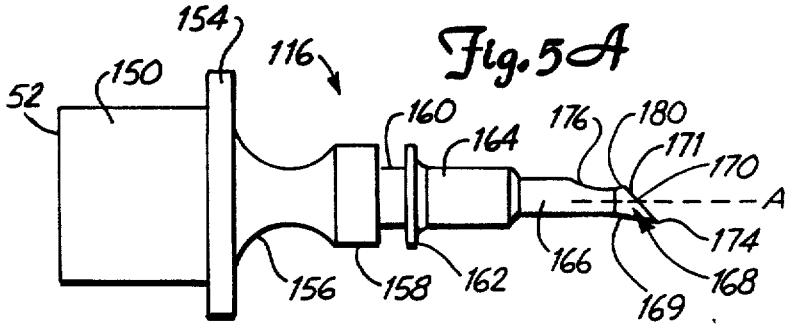
Fig. 5A
Fig. 5B
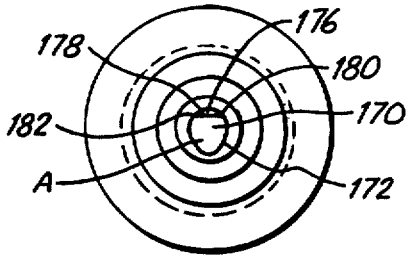
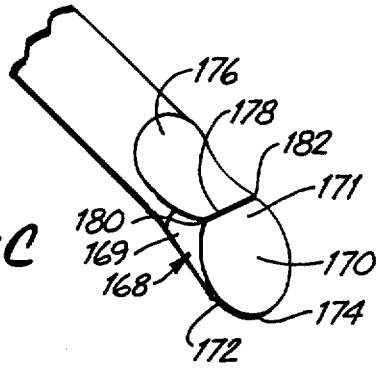
Fig. 5C
Fig. 5E
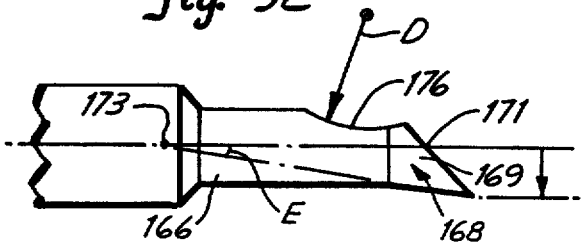
Fig. 5D
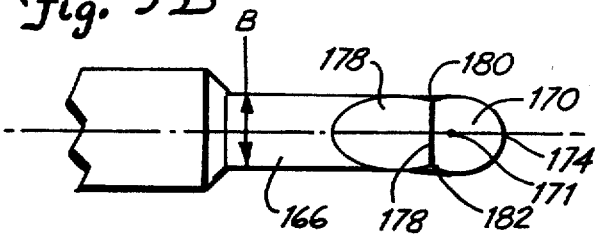
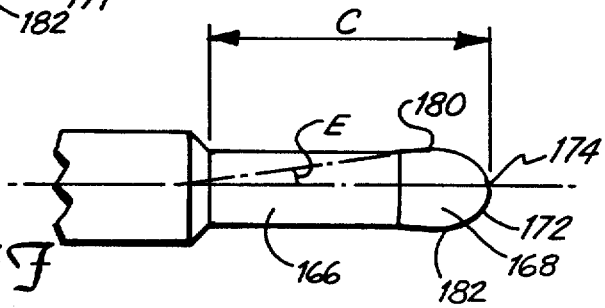
Fig. 5F

PUNCTURE DISC INFLATION VALVE WITH IMPROVED CUTTING BAYONET

BACKGROUND OF THE INVENTION

1. Field of the Invention.

The present invention relates to inflation valves, such as are used in life raft inflation systems. In particular, the present invention is an improved bayonet for puncture disc inflation valves 2. Description of the Prior Art.

Inflatable life rafts have found wide use on ocean-going ships and aircraft. An inflatable life raft offers the advantage of light weight and small size. It is stored in its deflated condition for long periods of time when it is not needed, and yet can be inflated rapidly when it is needed to form a raft capable of holding people.

Inflatable life rafts are inflated using a pressurized inflation gas (such as carbon dioxide, dry air, or nitrogen) which is contained in a pressure tank or pressure vessel. When the raft is to be inflated, a valve is actuated by pulling a pull cable which is connected at one end to the valve actuating mechanism in such a manner as to allow the cable to pull free after the firing mechanism has been actuated. When the pull cable is pulled, the actuating mechanism fires the valve, causing it to open to permit the pressurized fluid to expand and fill the life raft.

One type of inflation valve which has been used in the past, is a "puncture disc" type of valve. This valve uses a disc (the "puncture disc") which normally blocks the passage connecting the inlet of the valve to the outlet of the valve. A bayonet or spear is provided for contacting and cutting or tearing the puncture disc open. An actuation mechanism is provided for moving the bayonet toward a sufficiently forceful collision with the disc to open the disc. Gas then flows from the pressure tank through the inlet, through the passage, and through the rupture in the puncture disc to the outlet and then to the inflatable article, such as a life raft.

Puncture discs of various kinds have been proposed in the past. Examples of puncture disc inflation valves are shown in the following U.S. patents. Hinchman U.S. Pat. No. 2,120,248; Davis U.S. Pat. No. 3,266,668; Bernhardt et al U.S. Pat. No. 3,526,339; Martin U.S. Pat. No. 3,757,371; McDaniel et al U.S. Pat. No. 3,887,108; Milgram U.S. Pat. No. 3,938,704; Legris U.S. Pat. No. 4,356,936; and Mackal U.S. Pat. No. 4,475,664.

Prior art bayonets have been subject to occasional misfire, probably as a result of tearing or incompletely cutting the puncture disc. Such misfires include the bayonet penetrating the puncture disc, catching on the disc and failing to clear the disc thereafter to allow gas to pass therethrough. Tearing or shearing of the disc can also result in portions of the disc breaking free and jamming elsewhere in the valve. Shearing of the metal of the disk also requires more force than cutting through the disc. Such misfires result in slow or incomplete inflation of the life raft. Such misfires occur most commonly under marginal operating conditions which may be the result of extreme weather where rapid and complete inflation of the raft may be most urgently needed.

SUMMARY OF THE INVENTION

The present invention is a puncture disc inflation valve which includes a cutting head disposed on bayonet piston for cleanly puncturing a puncture disc, and thereafter cleanly escaping the puncture hole under pressure of escaping gas. A cylinder head has an inlet at a first end, a recess at a second end, and an inlet passage which connects the inlet and the recess. The puncture disc is positioned in the recess to block the inlet passage. Disc retainer means holds the puncture disc in position in the passage to seal the inlet passage and prevent gas flow.

The firing head has an outlet and an outlet passage which is connected to the outlet. The bayonet piston is movable within the outlet passage, and has a bias force applied to it in a direction toward the puncture disc. The cutting head is disposed on the distal end of the bayonet piston, pointed toward the puncture disc. The cutting head is shaped in the form of an inverted right circular cone portion, with the base or wide end of the cone portion at the extreme distal end of the bayonet and closest to the puncture disc. A semielliptical cutting edge is formed on the cutting head along the edge of a planar cutting face formed as a base to the right circular conical portion. The cutting face is formed at about a 45° angle relative to the central axis of the cone portion. The directrix of the cone portion forms about a 7° angle with the central axis. The semielliptical cutting edge is limited by a relief portion in the base of the right circular cone away from the most extreme distal portion of the cutting edge. The cutting head is oriented so that the central axis of the cone is perpendicular to the disc. The cutting head is moved along the central axis bringing the cutting head into contact with the surface of the disc along its cutting edge. The geometric profile of the head insures that the head presents an acute cutting angle to the surface.

An actuator holds the bayonet piston in a position separated from the puncture disc and, when actuated, releases the bayonet piston to cause the bias force to drive the cutting edge toward the puncture disc to puncture the disc and described above and permit the flow of gas from the inlet, through the inlet passage, the disc and the outlet passage, to the outlet. Escaping high pressure gas pushes the bayonet piston clear of the puncture so that gas flow is unimpeded.

BRIEF DESCRIPTION OF THE DRAWINGS

FIG. 5A is a perspective view of the bayonet piston;

FIG. 5B is a top view of the cutting head of the bayonet piston shown in FIG. 5A viewed from the distal end of the bayonet piston;

FIG. 5C is a perspective view of the cutting head of the bayonet piston;

FIG. 5D is a back side view of a cutting head of the bayonet piston illustrating a relief portion thereof;

FIG. 5E is a side view of the cutting head;

FIG. 5F is a front side view of the cutting head;

DETAILED DESCRIPTION OF THE PREFERRED EMBODIMENTS

Figure 1:
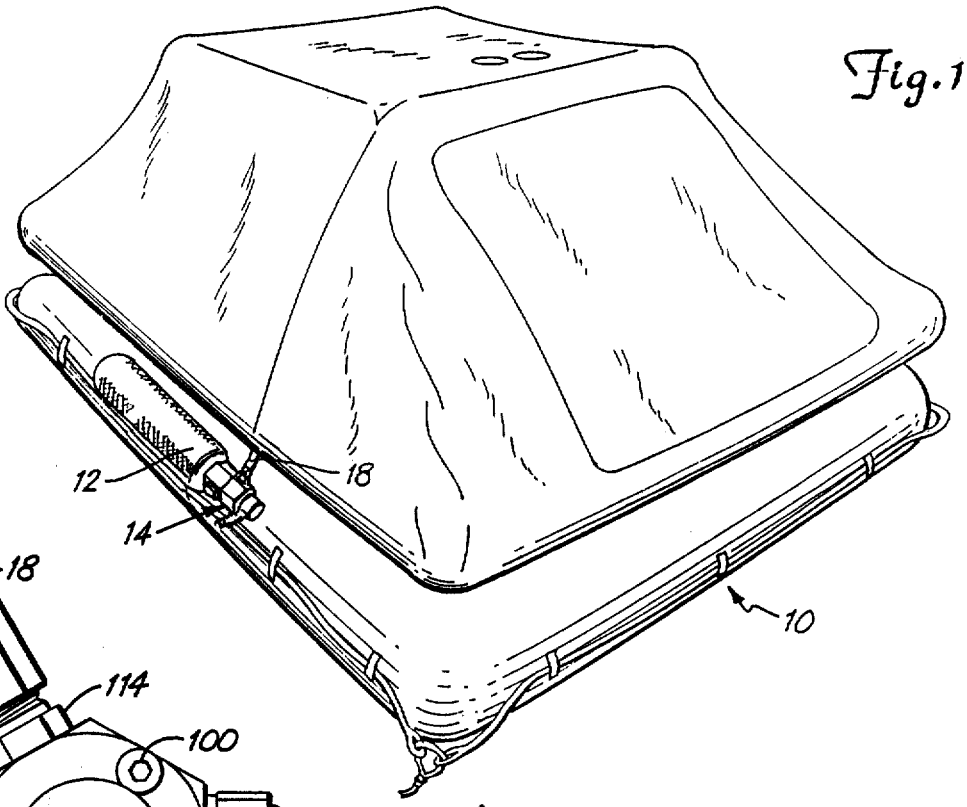
FIG. 1 is a perspective view of an inflatable life raft.

FIG. 1 shows an inflatable life raft 10 in its fully inflated condition. The pressurized gas used to inflate life raft 10 has been supplied from one or more pressure vessels or tanks 12 which are attached to and carried by raft 10. Pressure tank 12 is typically a metal or metal lined fiberglass tank which contains an inflation gas stored under pressure. Each pressure tank 12 has a raft inflation valve 14 attached at one end. Under normal storage conditions, life raft 10 is deflated, folded and stored in a compact package. A pull cable 16 (FIG. 2) is pulled to actuate valve 14, which causes valve 14 to open, thus allowing inflation gas from pressure tank 12 to pass through valve 14 and outlet hose 18 into the interior of life raft 10.

Figure 2:
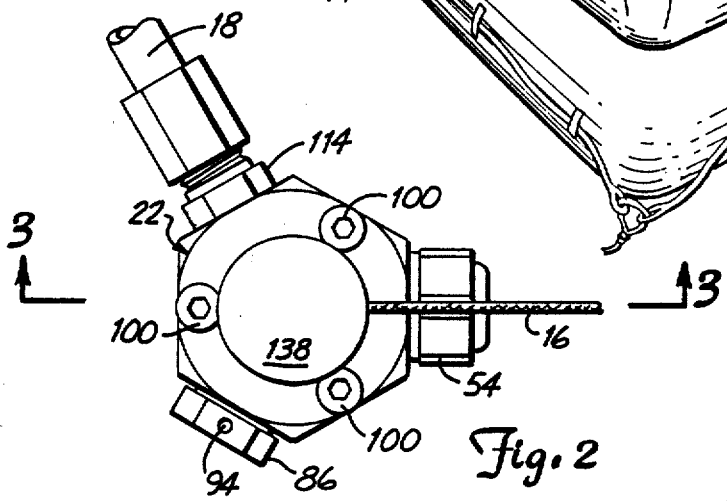
FIG. 2 is an end view of the inflation valve of the present invention.
Figure 4:
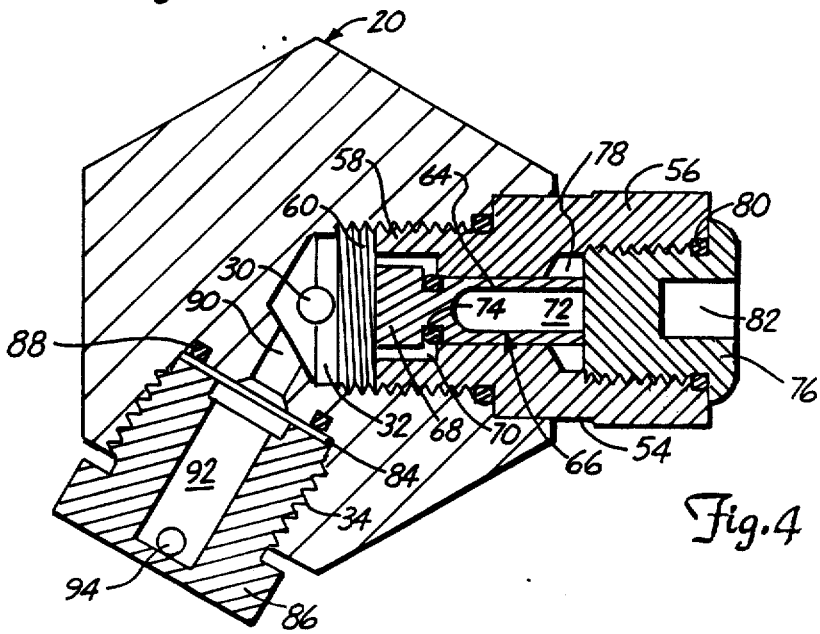
FIG. 4 is a sectional view along section 4—4 of FIG. 3.
Figure 3:
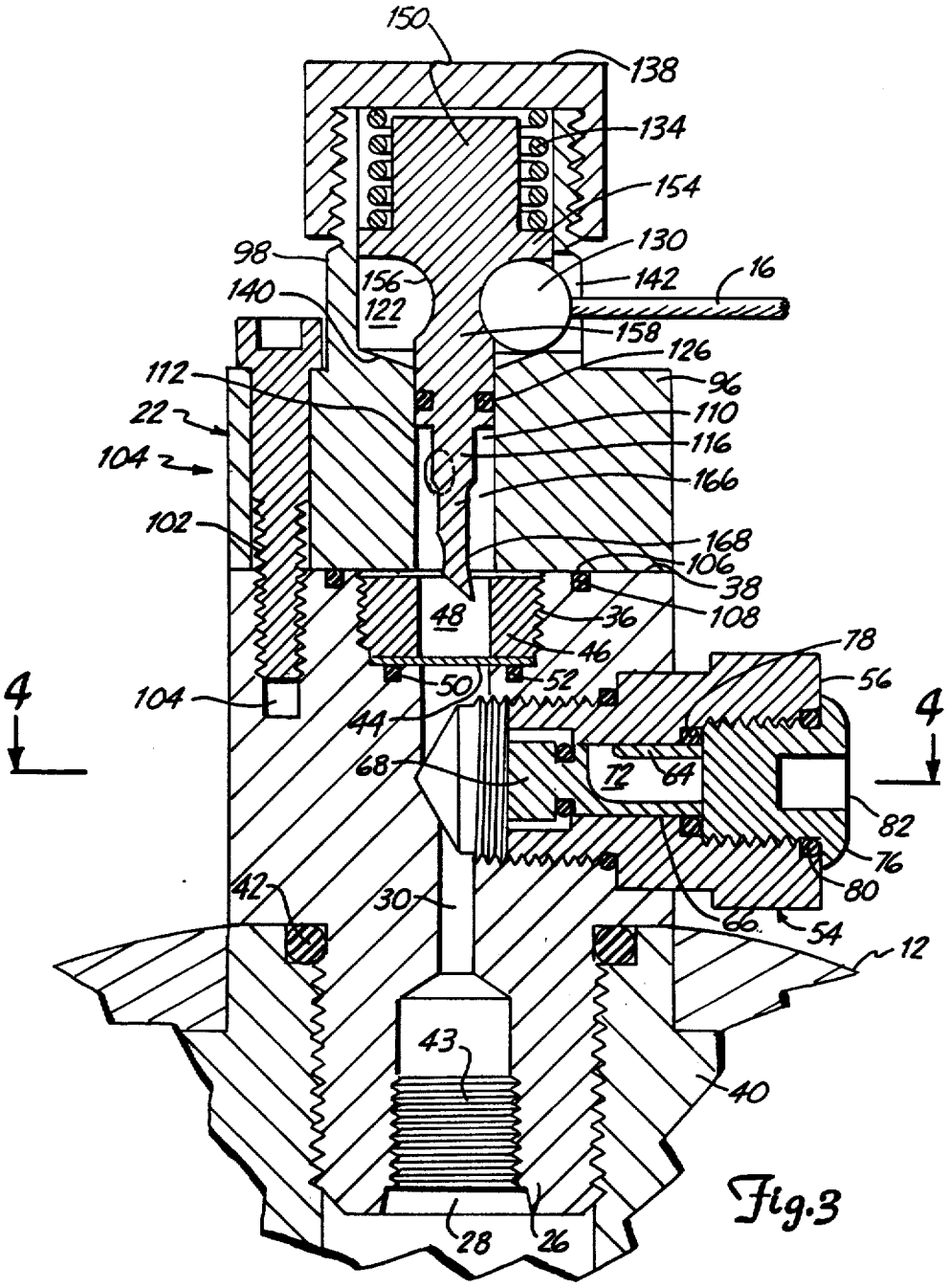
FIG. 3 is a sectional view along section 3—3 of FIG. 2.
Figure 6:
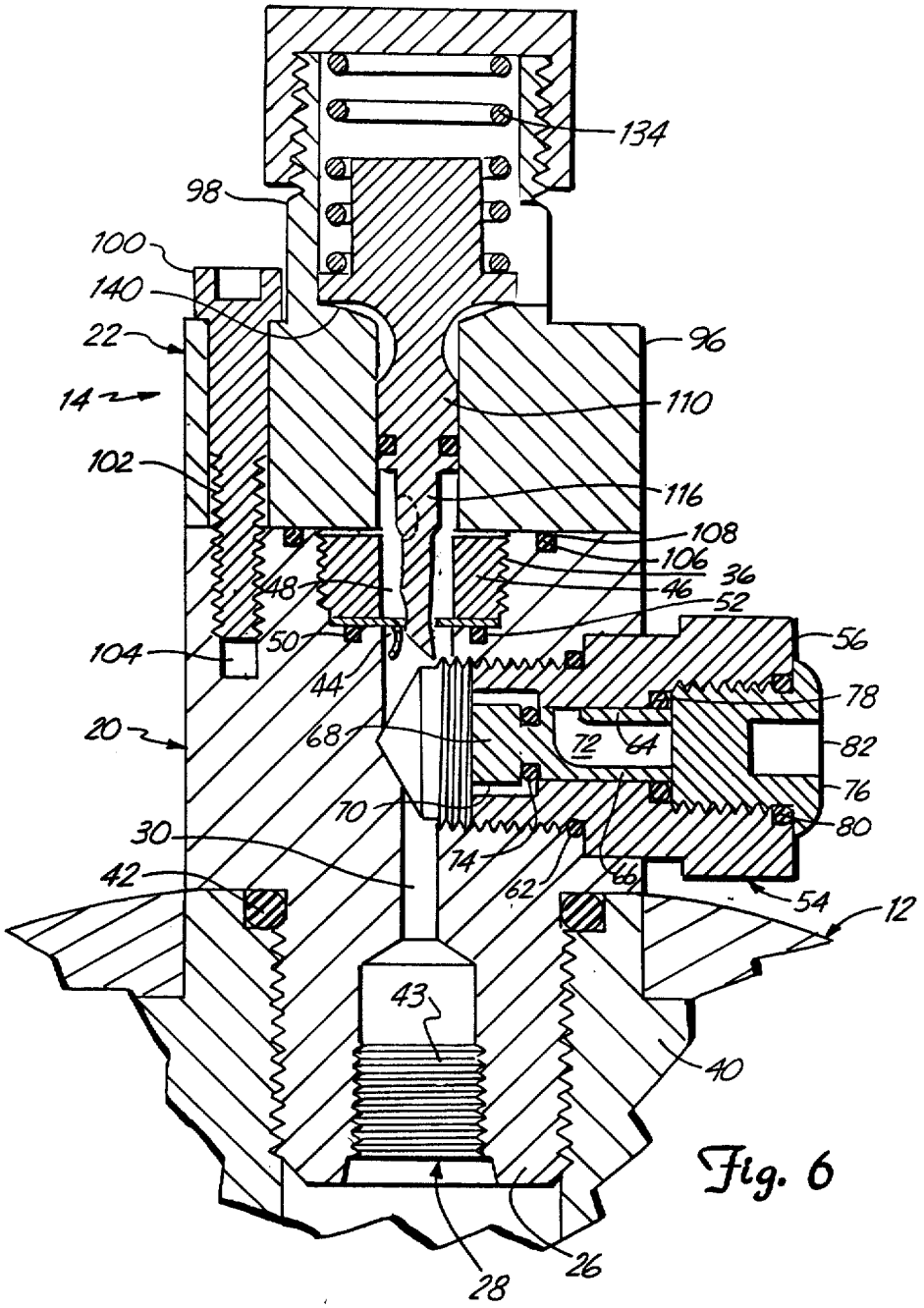
FIG. 6 is a sectional view of the inflation valve with the bayonet puncturing the puncture disc of the inflation valve.
Figure 7:
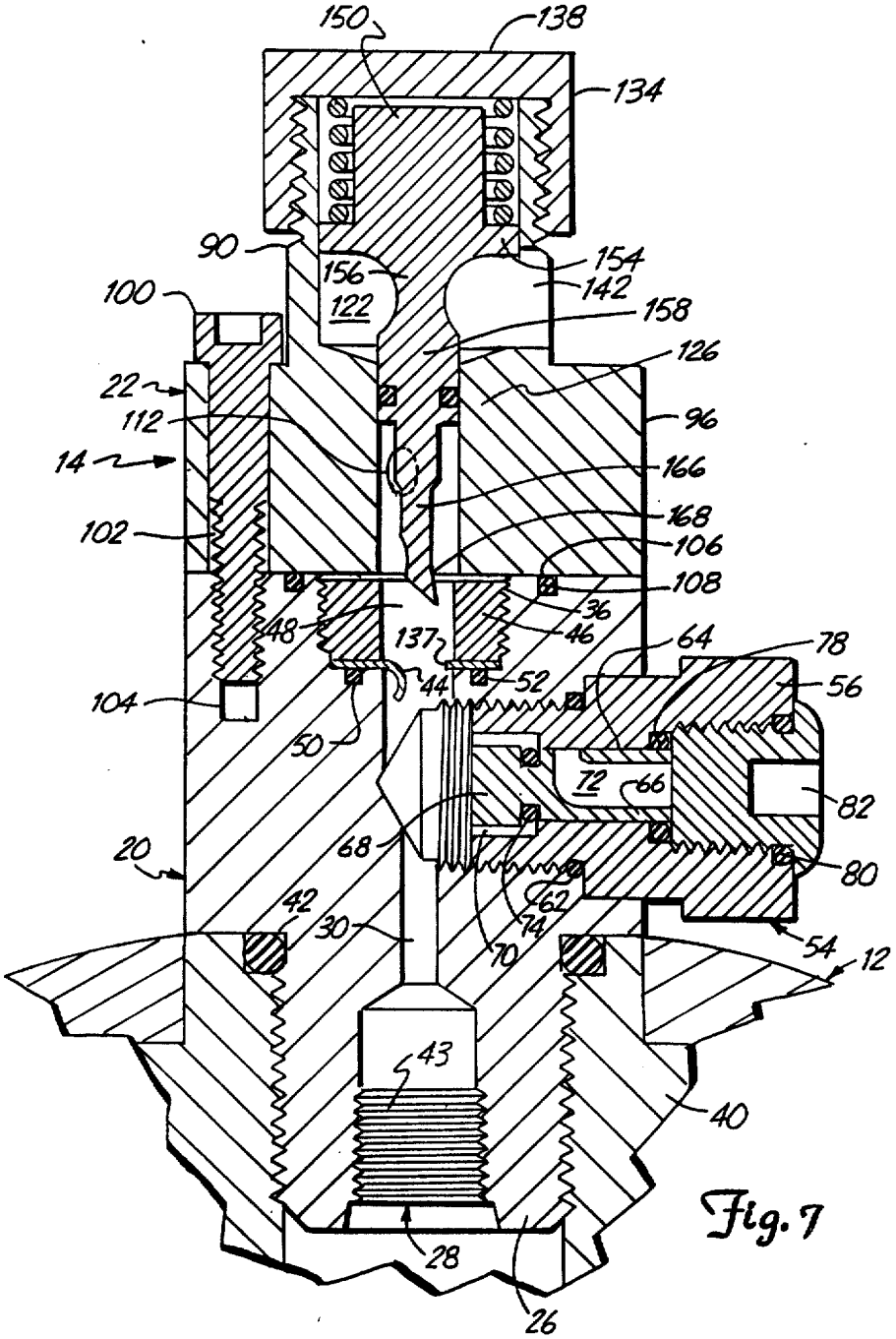
FIG. 7 is a sectional view of the inflation valve with the bayonet piston pushed clear of the punctured disc.

FIGS. 2, 3 and 4 show valve 14 in its normal operating state prior to actuation. FIGS. 5A–F show the bayonet piston of the present invention in greater detail. FIGS 6 and 7 illustrate actuation of a value 14. Inflation valve 14 is a puncture disc valve.

Cylinder head 20 is a hexagonal body having a threaded neck portion 26, inlet port 28, inlet passage 30, fill port 32, safety relief port 34 and a threaded recess 36 in end surface 38. Threaded neck 26 mates with threaded receptacle 40 of tank 12. O-ring 42 provides a seal between cylinder head 20 and receptacle 40. Inlet 28 is in communication with the interior of tank 12, and inlet passage 30 extends from inlet 28 to recess 36. As shown in FIG. 3, inlet port 28 includes an internal threaded portion 43 which permits optional connection to a siphon tube (not shown).

Puncture disc 44 closes inlet passage 30 so that in the normal, unactuated state of valve 14, gas flow out of tank 12 is prevented. Puncture disc 44 is held in place by disc retainer 46, which has external threads which mate with the internal threads of recess 36. Retainer 46 has an interior passage 48 which is aligned with inlet passage 30 and which exposes the central portion of puncture disc 44.

O-ring 50 is positioned in an annular groove 52 at the bottom of recess 36 to provide a seal between cylinder head 20 and puncture disc 44. This arrangement provides a very reliable seal, because O-ring 50 is in contact with metal (cylinder head 20 and puncture disc 44) on both sides.

Fill fitting 54 is located in fill port 32. As best shown in FIGS. 3 and 4, fill fitting 54 includes a fill valve body 56 having a threaded neck 58 which engages threads 60 in fill port 32. O-ring 62 provides a seal between cylinder head 20 and fill valve body 56.

Fill valve body 56 has an inner cylinder 64 in which a free-floating piston 66 is located. Piston 66 has a piston head 68 located at one end. Piston head 68 is located in opening 70 of valve body 56. Head 68 is larger in diameter than cylinder 64, thus limiting the outward movement of floating piston 66. The main body of piston 66, which slides in cylinder 64, has a central passage 72 through which gas can be delivered into opening 70, which communicates with passage 30 and thus with inlet 28 and the interior of tank 12. O-ring 74 is mounted on piston 66 to provide a seal between piston 66 and cylinder 64 when piston 66 is in its outermost position.

Although the pressure differential between the interior of tank 12 and the atmosphere will cause piston 66 to be driven outward and thus prevent the flow of gas out through fill fitting 54, backup cap 76 is preferably threaded into the internally threaded bore 78 of fill fitting 54. O-ring 80 provides a backup seal to prevent leaking from fill fitting 54. Backup cap 76 has a hexagonal wrench opening 82 in its outer surface to facilitate insertion and removal.

To fill tank 12, a complementary fill fitting (not shown) from a compressed gas source is fitted into threaded bore 78 of fill fitting 54. Piston 66 is forced inwardly by the differential pressure so that passage 72 is exposed to opening 70 and thus is in communication with fill port 32, inlet passage 30, and the interior of tank 12.

Once filling is completed, the pressure to the fill fitting is dropped, so that the pressure differential is reversed. Piston 66 is driven outward by the differential pressure to close passage 72 and prevent the flow of gas out from tank 12. Backup cap 76 is then inserted into threaded bore 78 to provide a backup seal.

Valve 14 includes a safety relief which prevents an explosion in the event that gas pressure within tank 12 reaches an unsafe level. The safety relief includes frangible disc 84, disc retainer nut 86, and O-ring 88. Frangible disc 84 is located in safety port 34 at the outer end of safety passage 90. At its inner end, safety passage 90 communicates with inlet passage 30.

Retainer nut 86 is threaded into safety port 34, and holds frangible disc 84 in a position where it seals safety port 34. If the pressure within tank 12 exceeds a predetermined level, frangible disc 84 ruptures. This permits inflation gas to escape from tank 12 through inlet 28, inlet passage 30, safety passage 90, through disc 84, into passage 92 of retainer nut 86, and out of discharge vents 94.

In its normal operating configuration as illustrated in FIGS. 1–4, valve 14 has firing head 22 mounted on top surface 38 of cylinder head 20. Firing head 22 includes a hexagonal body 96 having an integral threaded neck portion 98 at its outer end. Firing head 22 and cylinder head 20 are connected together by three screws 100 which extend through holes 102 in body 96 and are threaded into threaded holes 104 in cylinder head 20. O-ring 106, which is located in groove 108 in surface 38 of cylinder head 20 provides a seal at the interface between firing head 22 and cylinder head 20.

Body 96 has a cylinder 110 which is coaxially aligned with passage 48 in retainer 46 and inlet passage 30 of cylinder head 20. Outlet passage 112 connects cylinder 110 to outlet fitting 114. Hose 18 (or an inlet check valve) is coupled to outlet fitting 114 to connect valve 14 to raft 10.

Bayonet piston 116 is positioned in cylinder 110. At a proximal end, bayonet 116 has a ballast head 150 which carries the substantially greater part of the mass of bayonet piston 116. Ballast head 150 is located within cavity 122 of neck portion 98 of firing head 22. Between cutting head 168 and ballast head 150, bayonet 116 includes a piston portion 158 which is of essentially the same diameter as cylinder 110, and which carries an O-ring 126 to provide a seal between bayonet 116 and cylinder 110. Adjacent to ballast head 150, is a flange 154 and a ball receiving groove 156, which mates with pull cable ball 130, which is mounted at the end of pull cable 132.

Helical spring 134 is concentrically mounted on ballast head 150 with one end against flange 154 and its opposite end against the inner surface of spring retainer cap 138. Spring 134 applies a bias force to bayonet 116 in a direction toward puncture disc 44 when ball 130 is in place.

As shown in FIG. 3, ball 130 normally rests in groove 156 and in ramp 140 which is concentrically positioned around cylinder 110. The bias force of spring 134 seats ball 130 in ball retaining groove 156 and ramp 140 and holds ball 130 in place. Because ball 130 must be pulled over ramp 140 before being pulled out through side opening 142 in neck 98, a "detent" action is achieved so that accidental "hair trigger" firing by small inadvertent forces on cable 132, particularly during raft packing, is essentially eliminated.

O-ring 126, which is mounted on piston 158, is preferably a Teflon-coated O-ring. This prevents adherence between O-ring 126 and the walls of the cylinder 110.

Bayonet piston 116 is illustrated in FIGS. 5A-5F. Bayonet piston 116 includes ballast head 150 at its proximal end. Ballast head 150 has a beveled 152 at the extreme proximal end of bayonet 116 edge and is adjacent spring retaining flange 154. Ball receiving groove 156 occurs adjacent spring retaining flange 156. After groove 156, toward the distal end of bayonet piston 116, is a piston portion 158. An O-ring receiving groove 160 (with O-ring removed) is positioned between piston portion 158 and a retaining flange 162. A central shaft portion 164, a support shaft 166 and a cutting head 168, which is at the distal end of bayonet 116, complete the bayonet.

Support shaft 166 is cylindrical in shape. Cutting head 168 is disposed at the end of support shaft 166, being formed with a back face 169 having the shape of a cone with a base at the extreme distal end of bayonet 116. Cutting head 168 has a cutting face 170 which cuts across center line of support shaft 166 at an angle of between about 40° and 50° and preferably at 45°. The intersection of cutting face 170 with back face 169 forms cutting edge 172 which has the shape of an ellipse centered on point 171 on the surface of the cutting face. Lead point 174 of cutting edge 172 is at the extreme distal tip of bayonet 116. Relief portion 176 is formed into the side of support shaft 166 and cutting head 168 opposite lead point 174. Relief portion 176 is a semicircular indentation in support shaft 166 and cutting head 168, intersecting with cutting face 170 along edge 178. Edge 178 is positioned to intersect cutting edge 172 to form end points 180 and 182 of the cutting edge. End points 180 and 182 are located at the transition point from acute to obtuse of the cutting angle of cutting edge 172.

Cutting head 168 will, in use, impinge a puncture disc beginning at lead point 174 and will thereafter cut through the puncture disc in two directions along cutting edge 172 until end points 180 and 182 are pushed through the plane of the puncture disc. The points of contact between cutting edge 172 and the puncture disc will, relative to the point of initial impingement, move toward relief portion 176 along the cutting edge. An acute cutting angle is presented by cutting edge 172 to a puncture disc as cutting head 168 is advanced toward the disc along the central axis of the cutting head. An acute angle, to the substantial exclusion of an obtuse angle, is presented by cutting head 168 to the disc as a byproduct of the geometric profile of the cutting head. The conical shape of back face 169 and the positioning of relief portion 176 to provide termination of cutting edge 172 at end points 180 and 182 provides that at all points along cutting edge 172 between end points 180 and 182, have an acute interior angle between back face 169 and cutting face 170. As any given point on cutting edge 172 comes into contact with the disc surface, the angle between cutting face 170 and back face 169, contained in a plane perpendicular to the disc surface and through the central axis of the shaft is acute. The interior angles at terminating points 180 and 182 are preferably right angles or acute. Cutting face 170 pushes a flap of material formed from a puncture disc by cutting edge 172 down and curled under the puncture disc. A puncture disc is opened by cutting the disc along cutting edge 172 and not by tearing or shearing the disc. Were cutting head 168 to present a cutting edge with an obtuse cutting angle to the surface of the disc, it would not cut the disc, but at best tear or shear the disc.

The shape of cutting edge 172 and cutting head 168 results in a cleanly cut puncture without tearing of the disc. Cutting edge 172 and edge 178 define the perimeter of a puncture cut in the puncture disc. The size and shape of the hole cut are sufficient to allow the rest of cutting head 168, when viewed vertically along central axis A, to clear the edges of the puncture cut.

Measurements of interest in a preferred cutting head 168 are illustrated in FIGS. 5D-5F. Support shaft 166 has a diameter "B" of 0.100". The length "C" of support shaft 166 and cutting head 168 to midpoint 174 is about 0.400". About one-third of this length is cutting head 168. Midpoint 174 is radially displaced about 0.065" from central axis A. Relief portion 176 in support shaft 166 and cutting head 168 is formed along an arcuate section with a radius "D" of about 0.1875". At its root, relief portion 176 leaves a shaft thickness of 0.075". Angle "E" defines a directrix from central axis "A" and vertex 173 along the conic portion of cutting head 168. Angle E is between 5° and 7° and is preferably 6°.

As illustrated in FIGS. 6 and 7, valve 14 is actuated when a suitable force is applied to pull cable 132 so that ball 130 (shown in FIG. 3) is pulled out of firing head 22 through opening 142. Spring 134 drives bayonet 116 so that cutting head 168 punctures disc 44. The travel of bayonet 116 is limited so that only cutting head 168 and a small portion of shaft 166 actually pass through puncture disc 44. Once disc 44 is punctured, the gas pressure from within tank 12 will exert a force on bayonet 116 in the opposite direction and will push cutting head 168 away from the now punctured disc 44. The gas from within tank 12 flows out through inlet 28, inlet passage 30, through the opening 137 in puncture disc 44, through passage 48, through cylinder 110 and through outlet passage 112 to outlet fitting 114 and hose 18. O-ring 126 prevents the gas from exiting firing head 22 past piston 116 and out through cavity 122 and opening 142.

It is preferred that the length of ballast head 150 be greater than the fully compressed height of spring 134, so that spring 134 will not be damaged when piston 116 is forced against spring retainer cap 138 by the release of compressed gas through puncture disc 44. Thus spring 134 may be reused when valve 14 is rebuilt.

Penetration of puncture disc 44 by cutting head 168 produces a clean and predictable puncture in puncture disc 44. Cutting edge 172 cuts puncture disc 44 along decreasing acute angles until terminating points 180 and 182 are reached. After initial impingement with puncture disc 44 following actuation, cutting head 168 folds puncture disc 44 over on a lengthening straight line segment under cutting face 170 between impinging contact points of cutting edge 172 and disc 44. After the entire length of cutting edge 172 has been driven through disc 44, the body of cutting head 168 tapers downward in size relative to the puncture hole and can be easily pushed clear of the hole back in the direction cutting head 168 entered. Because the puncture hole is formed by a positive approach angle along cutting edge 172, puncture disc 44 is not torn.

Limiting the taper of the cutting head 168 to 7° ensures cutting head 168 is sufficiently strong around cutting edge 172 to resist breakage and preserve bayonet 116 for reuse. Similarly, not exceeding an angle of about 40° from vertical between cutting face 170 and central axis "A" produces lead portions of cutting edge 172 strong enough to resist breakage. Use of materials other than normal tool grade steel potentially offers the possibility of a cutting face 170 closer to vertical and a large flare of back face 169, both of which would contribute to a longer acute cutting edge.

In conclusion, the present invention is a puncture disc inflation valve which is reliable, simple to manufacture, simple to rebuild and recharge for reuse without special tools, and which provides extra reliability in use under extreme weather conditions.

Although the present invention has been described with reference to preferred embodiments, workers skilled in the art will recognize that changes may be made in form and detail without departing from the spirit and scope of the invention.

What is claimed is:

1. For use in a puncture disc inflation valve, a bayonet for puncturing a puncture disc, the bayonet comprising:

a cutting head having a back face formed in the shape of a cone with a central axis;

a planar cutting face disposed across a widening end of the cutting head and intersecting the central axis at between a 40° and a 50° angle for forming a cutting edge between the cutting face and the back face;

a lead point of the cutting edge where the intersection between the cutting face and the back face is furthest removed from the central axis;

a relief portion in the back face in the cutting head opposite the lead point; and a terminating edge between the cutting face and the relief portion forming end points to the cutting edge.

2. The bayonet defined in claim 1 wherein substantially all points of the cutting edge between the end points are vertices of acute interior angles between the cutting face and the back face.

3. The bayonet as defined in claim 2 wherein an angle between a directrix of the back face from the central axis is between 5° and 7°.

4. The bayonet defined in claim 1 wherein end points of the cutting edge occur where the cutting angle of the cutting edge is substantially a right angle.

5. The inflation valve as defined in claim 4, wherein the bayonet further comprises an angle of intersection between a directrix of the back face from the central axis not less than 5° or greater than 7°.

6. The inflation valve of claim 5, wherein the relief portion of the cutting head is an arcuate indentation in the back face.

7. The inflation valve of claim 6, wherein a depth of penetration through the puncture disc by the bayonet, when released, reaches but does not exceed the relief portion.

8. An inflation valve comprising:

a gas passage;

a puncture disc positioned in the gas passage for preventing the transmission of gas through the gas passage and having a high pressure side and a low pressure side;

a bayonet movable in the gas passage and disposed on the low pressure side of the puncture disc, the bayonet including;

a cutting head with a back face of a cone on a central axis;

a cutting face disposed across a widening end of the cutting head and intersecting the back face forming a cutting edge;

a lead point located on the cutting edge where the edge is furthest removed from the central axis;

a relief portion in the back face opposite the lead point;

a terminating edge between the cutting face and the relief portion forming end points to the cutting edge; and the cutting edge of the bayonet being oriented in the gas passage to impinge with the puncture disc for cutting the puncture disc when the valve is actuated;

bias means for applying a bias force to the bayonet in a direction toward the puncture disc; and actuating means for holding the bayonet in a position separated from the puncture disc and, when actuated, for releasing the bayonet to cause the bias force to drive the bayonet toward the puncture disc to cut open the disc and permit flow of gas through the gas passage and through the disc.

9. For use in a puncture disc inflation valve, a bayonet for puncturing a puncture disc, the bayonet comprising:

an elongated shaft having a longitudinal axis and a distal end portion;

a cutting head mounted around the distal end portion of the shaft, the cutting head having an outer surface which is outwardly tapered in the direction of the distal end portion at an angle of between 5° and 7° relative to the longitudinal axis;

a planar cutting face on the cutting head and distal end portion, the planar cutting face crossing the longitudinal axis of the shaft at an angle of between 40° and 50° and forming a terminating edge with the outer surface of the cutting head with an extreme distal terminating point;

a cutting edge formed along a portion of the terminating edge with the extreme distal terminating point as midpoint of the cutting edge;

a relief portion along the elongated shaft and cutting head away from the extreme distal terminating point and the cutting edge being terminated at each of two ends adjacent the relief portion.

10. An inflation valve comprising:

a gas passage;

a puncture disc positioned across the gas passage blocking the gas passage;

a bayonet movable in the gas passage and having a cutting end;

a cutting head disposed at the cutting end of the bayonet for puncturing the puncture disc, the cutting head having a back surface formed in the shape of an inverted right circular cone on a central axis, a planar bass surface disposed across the cutting head and a relief surface formed into the back surface; and a cutting edge formed on the cutting head along an edge between the back surface and the planar base surface, the planar base surface being angled such that the cutting edge initially presents an acute cutting angle to the puncture disc and the relief surface being positioned to limit the cutting edge such that the cutting edge presents an acute cutting angle to the puncture disc along substantially all points of contact occurrring between the cutting edge and the puncture disc as the cutting head moves through the puncture disc.

* * * * *